US011325818B2

(12) United States Patent
Dahlberg et al.

(10) Patent No.: US 11,325,818 B2
(45) Date of Patent: May 10, 2022

(54) HIGH FLOW, REDUCES FOAM DISPENSING NOZZLE

(71) Applicant: The Coca-Cola Company, Atlanta, GA (US)

(72) Inventors: Kirk Walter Dahlberg, Atlanta, GA (US); Youlung Chen, Marietta, GA (US); Charles Bradley Green, Dacula, GA (US); Josef Klucik, Marietta, GA (US); John Martin, Chicago, IL (US); Cassilyn Bair, Atlanta, GA (US); Robert B. Brownell, Jr., Decatur, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 310 days.

(21) Appl. No.: 15/128,576

(22) PCT Filed: Mar. 25, 2015

(86) PCT No.: PCT/US2015/021943
§ 371 (c)(1),
(2) Date: Sep. 23, 2016

(87) PCT Pub. No.: WO2015/148349
PCT Pub. Date: Oct. 1, 2015

(65) Prior Publication Data

US 2017/0190554 A1 Jul. 6, 2017

Related U.S. Application Data

(60) Provisional application No. 61/969,910, filed on Mar. 25, 2014.

(51) Int. Cl.
*B67D 1/00* (2006.01)
*B67D 1/12* (2006.01)

(52) U.S. Cl.
CPC ..... *B67D 1/0021* (2013.01); *B67D 1/005* (2013.01); *B67D 1/0046* (2013.01);
(Continued)

(58) Field of Classification Search
CPC ..... B67D 3/042; B67D 3/043; B67B 7/24; B67B 7/26; B65D 77/067
See application file for complete search history.

(56) References Cited

U.S. PATENT DOCUMENTS 2,408,664 A 10/1946 Lloyd
3,575,352 A 4/1971 Hall
(Continued)

FOREIGN PATENT DOCUMENTS

EP 288302 10/1988
EP 672616 9/1995
(Continued)

OTHER PUBLICATIONS

International Preliminary Report on Patentability, dated Oct. 6, 2016, for International Application No. PCT/US2015/021943, International Filing Date Mar. 23, 2015, Applicant—The Coca-Cola Company.

*Primary Examiner* — Vishal Pancholi
*Assistant Examiner* — Bob Zadeh
(74) *Attorney, Agent, or Firm* — Eversheds Sutherland (US) LLP

(57) ABSTRACT

The present application provides a dispensing nozzle for use with a flow of a diluent and a flow of a concentrate. The beverage dispenser may include an annular concentrate path of the flow of the concentrate and an annular diluent path surrounding at least in part the annular concentrate path for the flow of the diluent. The annular diluent path may include a shallow angle leading towards the flow of the concentrate
(Continued)

such that the flow of the diluent and the flow of the concentrate mix in or downstream of the dispensing nozzle.

6 Claims, 6 Drawing Sheets

(52) U.S. Cl.
CPC ..... *B67D 1/0052* (2013.01); *B67D 1/1272* (2013.01); *B67D 1/0078* (2013.01); *B67D 1/0085* (2013.01)

(56) References Cited

U.S. PATENT DOCUMENTS 3,966,091 A 6/1976 Bencie
4,108,363 A 8/1978 Susumu
4,218,014 A * 8/1980 Tracy ..... B05B 7/0408 222/144.5
4,270,673 A * 6/1981 Rodth ..... B67D 1/0044 137/606
4,509,690 A 4/1985 Austin
4,721,610 A * 1/1988 Yoshida ..... B01J 12/005 423/604
4,863,068 A * 9/1989 Smith ..... B67D 1/005 222/129.1
4,891,755 A 1/1990 Asher
4,928,854 A * 5/1990 McCann ..... B67D 1/0044 222/129.1
4,986,447 A 1/1991 McCann
5,048,726 A 9/1991 McCann
5,186,363 A 2/1993 Haynes
5,203,474 A 4/1993 Haynes
5,269,442 A 12/1993 Vogel
5,337,775 A * 8/1994 Lane ..... B65D 77/067 137/68.29
5,351,860 A * 10/1994 Gotoh ..... B67B 7/26 222/82
5,415,326 A 5/1995 Durham
5,526,959 A 6/1996 Green
5,607,083 A 3/1997 Vogel
5,728,999 A 3/1998 Teicher
6,173,862 B1 1/2001 Buca
6,345,729 B1 2/2002 Santy, Jr.
6,401,981 B1 * 6/2002 McCann ..... B67D 1/0042 222/129.1
6,766,656 B1 7/2004 Crisp, III
6,848,600 B1 2/2005 Crisp, III
6,857,541 B1 2/2005 Crisp, III
6,877,635 B2 4/2005 Stratton
6,896,159 B2 5/2005 Crisp, III
6,915,925 B2 7/2005 Crisp, III
7,004,355 B1 2/2006 Crisp, III
7,032,779 B2 4/2006 Crisp, III
7,383,966 B2 6/2008 Ziesel
7,669,737 B2 3/2010 Bethuy
7,708,164 B2 * 5/2010 Pritchard ..... A47K 5/1208 222/207
7,789,269 B2 * 9/2010 Pritchard ..... A47K 5/1208 222/207
8,091,737 B2 * 1/2012 Smeller ..... B67D 1/0044 222/1
8,387,829 B2 3/2013 Schroeder
8,528,786 B2 * 9/2013 Gates ..... B67D 7/74 222/1
8,857,740 B2 * 10/2014 Wurz ..... B05B 7/0458 239/405
9,434,594 B2 * 9/2016 Kaneko ..... B67D 1/005
9,862,533 B2 * 1/2018 Stever ..... B67D 3/043
2005/0045655 A1 * 3/2005 Santy ..... B67D 1/0043 222/129.1
2005/0072799 A1 4/2005 Stratton
2006/0191964 A1 8/2006 Ziesel
2006/0237479 A1 * 10/2006 Fox ..... B67D 1/0021 222/129.1
2006/0276933 A1 12/2006 Chavez
2007/0080169 A1 * 4/2007 Sher ..... B67D 1/0022 222/129.1
2007/0205219 A1 9/2007 Ziesel
2007/0205221 A1 9/2007 Carpenter
2008/0093382 A1 * 4/2008 Sher ..... B67D 1/0021 222/129.1
2009/0230149 A1 * 9/2009 Smeller ..... B67D 1/0024 222/145.5
2013/0042941 A1 2/2013 Van Haperen
2013/0203867 A1 * 8/2013 Tezuka ..... A23L 27/36 514/777
2014/0305969 A1 * 10/2014 Dittrich ..... B67D 3/0019 222/135
2016/0130126 A1 * 5/2016 Bhalerao ..... B67D 1/0043 239/10
2017/0008685 A1 * 1/2017 Stever ..... B67D 3/043
2017/0190554 A1 * 7/2017 Dahlberg ..... B67D 1/005
2018/0093808 A1 * 4/2018 Stever ..... B67D 3/043
2018/0111816 A1 * 4/2018 Stever ..... B67D 3/043

FOREIGN PATENT DOCUMENTS

EP 1038829 9/2000
GB 2256636 12/1992
GB 2269761 2/1994
JP 2003160196 6/2003
JP 2004359257 12/2004
WO 199008728 8/1990
WO 9113827 9/1991
WO 2011076520 6/2011

* cited by examiner

FIG. 5
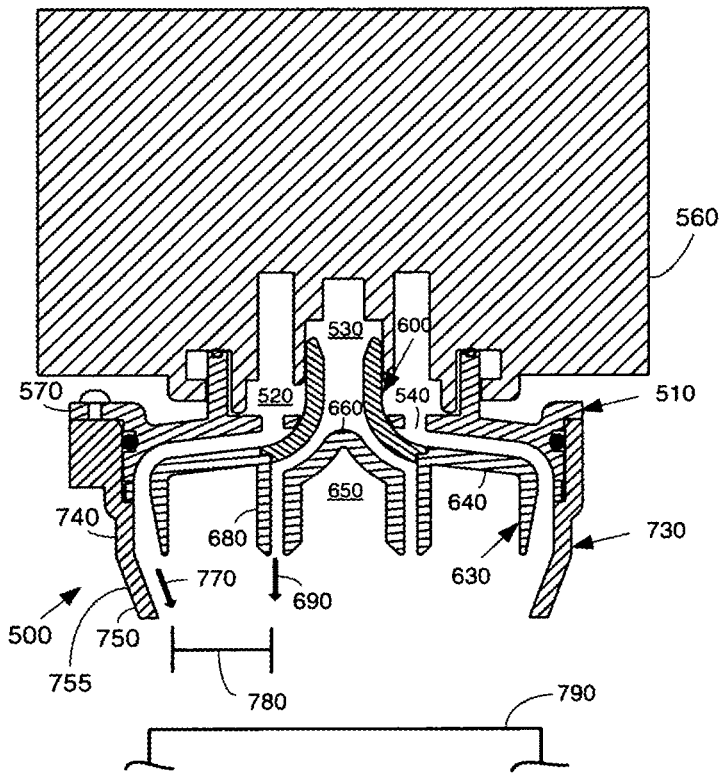
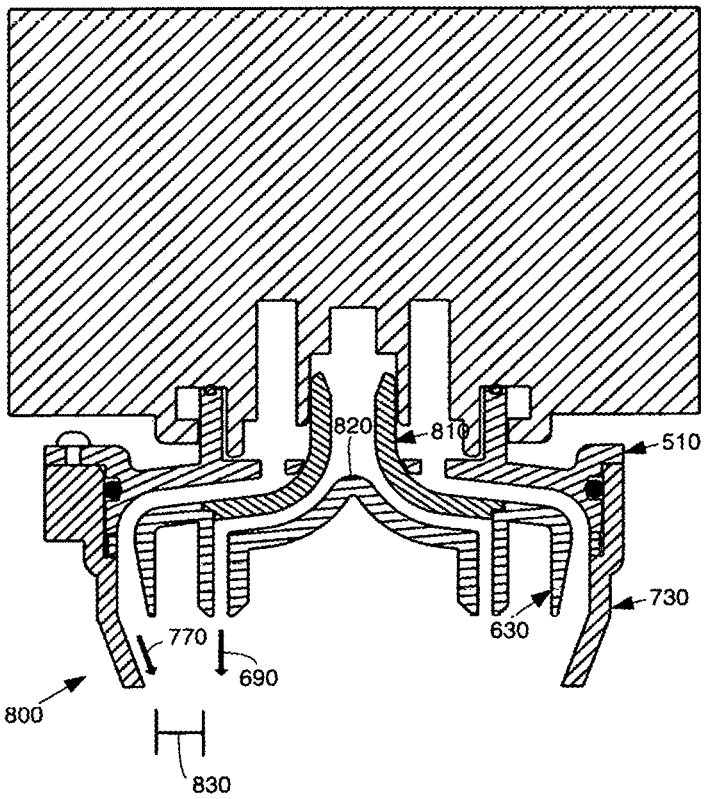
FIG. 6

FIG. 7
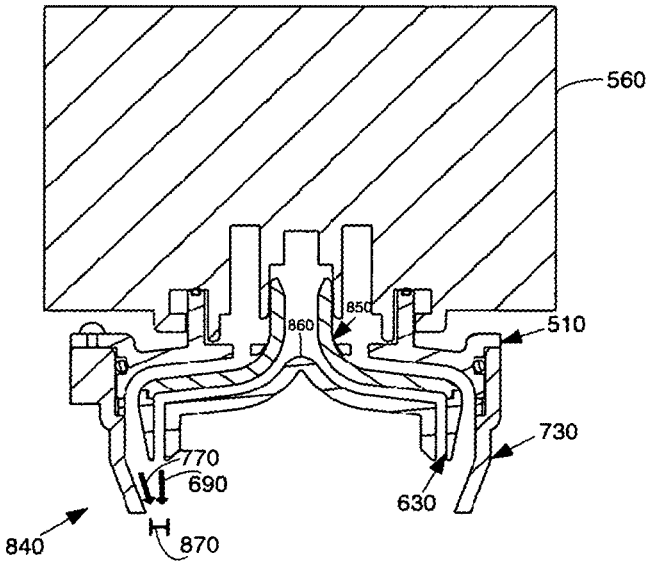
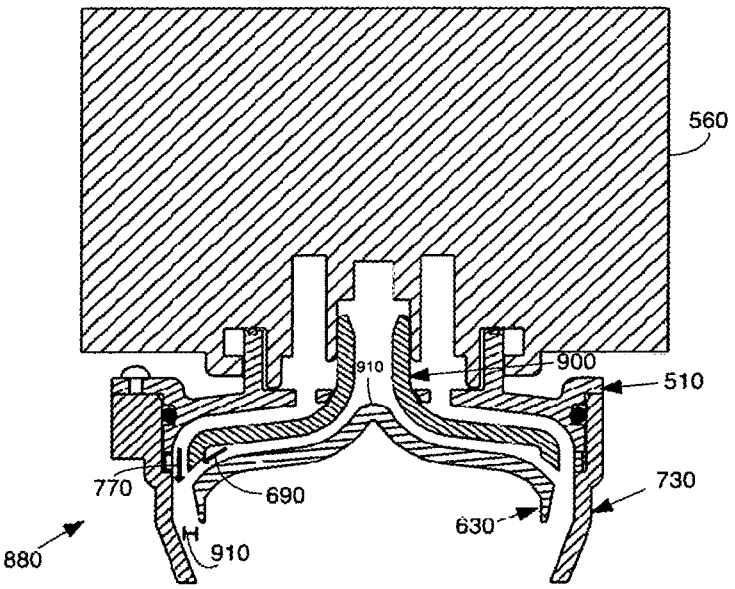
FIG. 8

HIGH FLOW, REDUCES FOAM DISPENSING NOZZLE

TECHNICAL FIELD

The present application and resultant patent relate generally to beverage dispensing systems and more particularly relate to a dispensing nozzle for use with a Stevia-based concentrate and other types of beverages with alternative sweeteners having reduced foaming during dispensing.

BACKGROUND OF THE INVENTION

Generally described, current post-mix beverage dispensers generally mix streams of syrup, concentrate, sweetener, bonus flavors, other types of flavoring, and/or other types of ingredients with water and/or other types of diluent by flowing the syrup stream down the center of the nozzle with the water stream flowing around the outside. The syrup stream may be directed downward with the water stream such that the streams mix as they fall into a cup so as to form the beverage. In order to accommodate increases in the variety of beverage types and flavors that may be dispensed, the beverage dispenser as a whole and the dispensing nozzles in particular may need to accommodate fluid flows with differing viscosities, flow rates, mixing ratios, temperatures, and other types of parameters.

For example, beverages with various types of alternative sweeteners are becoming popular. These alternative sweeteners include natural, non-caloric or low caloric sweeteners such as Stevia and the like. The use of Stevia as a sweetener, however, may alter the surface tension properties of the finished beverage. This change in the surface tension may be problematic in that large volumes of foam may be produced during dispensing. Such foaming may be an operational hindrance and may create a negative consumer impression.

There is thus a desire for a beverage dispenser in general and a dispensing nozzle in specific to accommodate different types of fluids that may pass therethrough. Specifically, there is a desire for a beverage dispenser and a dispensing nozzle that may accommodate Stevia-based beverages without excess foaming while maintaining adequate flow rates and good mixing.

SUMMARY OF THE INVENTION

The present application and the resultant patent thus provide a dispensing nozzle for use with a flow of a diluent and a flow of a concentrate. The beverage dispenser may include an annular concentrate path of the flow of the concentrate and an annular diluent path surrounding at least in part the annular concentrate path for the flow of the diluent. The annular diluent path may include a shallow angle leading towards the flow of the concentrate such that the flow of the diluent and the flow of the concentrate mix in or downstream of the dispensing nozzle. The concentrate may be a Stevia-based concentrate.

The present application and the resultant patent further provide a method of mixing a diluent and a Stevia-based concentrate by a dispensing nozzle to form a beverage in a cup. The method may include the steps of flowing the diluent in an annular diluent stream, flowing the Stevia-based concentrate in a spaced apart annular concentrate stream, and mixing the annular diluent stream and the spaced apart annular concentrate stream downstream of the dispensing nozzle so as to form the beverage in the cup.

The present application and the resultant patent further may provide a beverage dispenser. The beverage dispenser may include a diluent source with a flow of carbonated water, a concentrate source with a flow of a Stevia-based concentrate, and a dispensing nozzle for mixing the flow of the carbonated water and the flow of the Stevia-based concentrate. The dispensing nozzle may include an annular concentrate path for the flow of the Stevia-based concentrate and an annular diluent path surrounding at least in part the annular concentrate path for the flow of the carbonated water such that the flow of the Stevia-based concentrate and the flow of the carbonated water mix in or downstream of the dispensing nozzle.

These and other features and improvements of the present application and the resultant patent will become apparent to one of ordinary skill in the art upon review of the following detailed description when taken in conjunction with the several drawings and the appended claims.

BRIEF DESCRIPTION OF THE DRAWINGS

FIG. 5 is a side cross-sectional view of the dispensing nozzle of FIG. 4.

FIG. 6 is a side cross-sectional view of an alternative embodiment of a dispensing nozzle as may be described herein.

FIG. 7 is a side cross-sectional view of an alternative embodiment of a dispensing nozzle as may be described herein.

FIG. 8 is a side cross-sectional view of an alternative embodiment of a dispensing nozzle as may be described herein.

DETAILED DESCRIPTION

Figure 1:
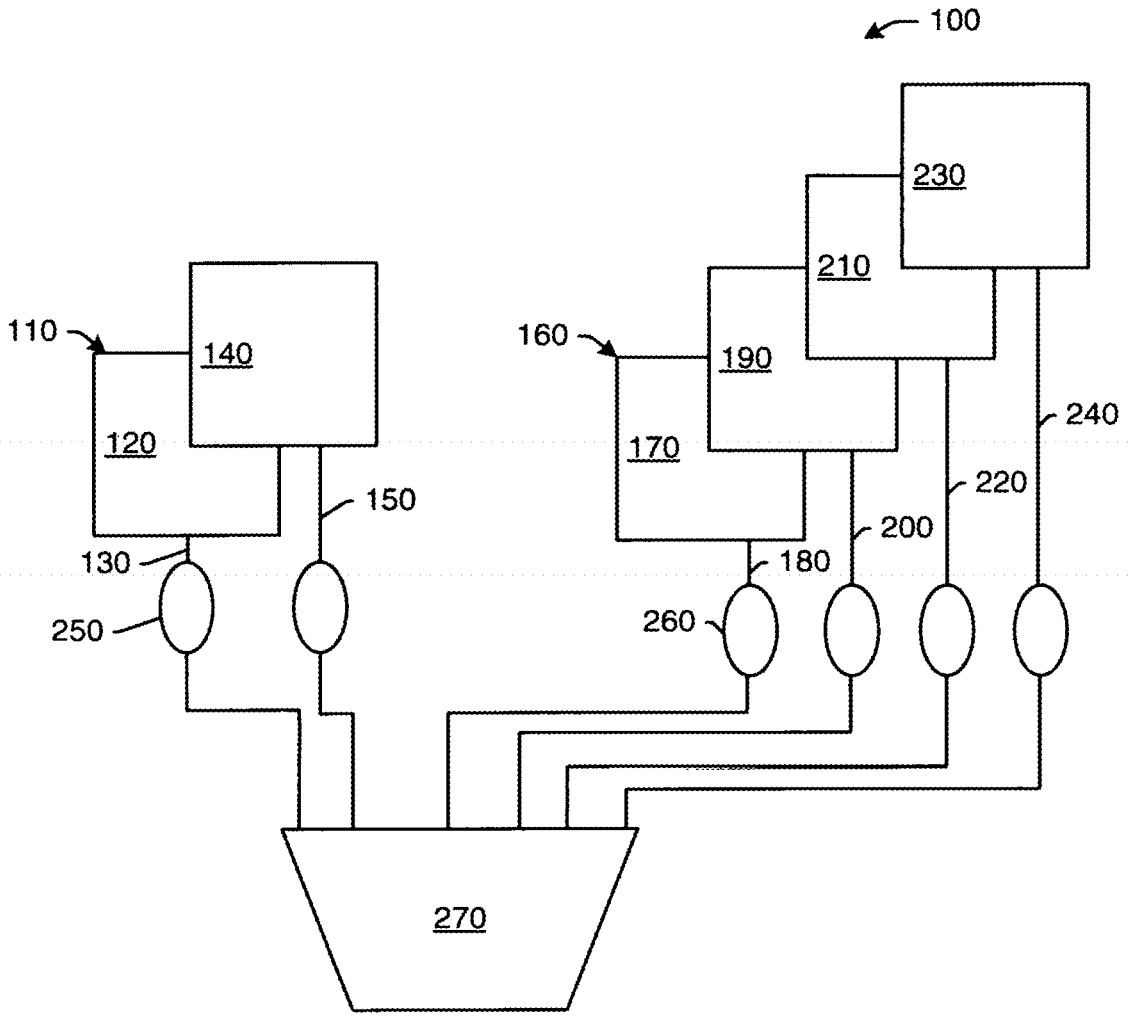
FIG. 1 is a schematic diagram of an example of a beverage dispenser with a dispensing nozzle.

Referring now to the drawings, in which like numerals refer to like elements throughout the several views, FIG. 1 shows an example of a beverage dispenser 100 as may be described herein. As described above, the beverage dispenser 100 may combine a number of ingredients to produce a number of different beverages 115 and the like. The beverage dispenser 100 may accommodate and mix any number or type of beverages herein.

Generally described, the beverage dispenser 100 may include one or more diluent sources 110. The diluent sources 110 may include a plain water source 120 for a flow of plain water 130 and a carbonated water source 140 for a flow of carbonated water 150. Other types of diluents may be used herein with varying levels of carbonation. The beverage dispenser 100 also may include one or more concentrate sources 160. The concentrate sources 160 may include a sugar-based concentrate source 170 for a flow of a sugar-based concentrate 180, an artificial sweetener-based concentrate source 190 for a flow of an artificial sweetener-based concentrate 200, a natural non-caloric sweetener-based concentrate source 210 for a flow of a natural non-caloric sweetener-based concentrate 220, and the like. In this example, one of the natural non-caloric sweetener-based concentrate sources 210 may be a Stevia-based concentrate source 230 for a flow of a Stevia-based concentrate 240. Other types of concentrate sources 160 and other types of fluid flows may be used herein.

Although the concentrate sources 160 described above contain the different types of sweeteners, the sweeteners and the other beverage ingredients may be further separated into macro-ingredients and micro-ingredients. Generally described, the macro-ingredients may have reconstitution ratios in the rage of about three to one (3:1) to about six to one (6:1). The viscosity of the macro-ingredients typically may be about thirty (30) centipoise or higher. The macro-ingredients may include sugar syrups, HFCS (High Fructose Corn Syrup), juice concentrates, and similar types of fluids. Similarly, a macro-ingredient-based product may include sweetener, acid, and other common components. The concentrates, sweeteners, and base products generally may be stored in conventional bag-in-box containers and the like.

The micro-ingredients may have reconstitution ratios ranging from about ten to one (10:1) to about twenty to one (20:1), thirty to one (30:1), or higher. Specifically, many micro-ingredients may be in the range of about (50:1) to about three hundred to one (300:1) or higher. The viscosities of the micro-ingredients typically range from about one (1) to about one hundred (100) centipoise or so. Examples of micro-ingredients include different types of natural and artificial flavors; flavor additives; natural and artificial colors; artificial sweeteners (nutritive, non-nutritive, high potency, or otherwise); various types of high potency natural sweeteners including Stevia-based sweeteners; additives for controlling tartness, e.g., citric acid, potassium citrate; functional additives such as vitamins, minerals, herbal extracts, nutraceuticals, over-the-counter medicines such as acetaminophen, and similar types of materials. The micro-ingredients may be liquid, powder (solid), or gaseous forms and/or combinations thereof. The micro-ingredients may or may not require refrigeration. Non-beverage substances such as paints, dyes, oils, cosmetics, and the like also may be used. Various types of alcohol may be used as micro-ingredients or macro-ingredients. An example of a beverage dispenser using macro-ingredients and micro-ingredients is shown in commonly owned U.S. Pat. No. 7,757,896, which is incorporated herein by reference in full. The ingredients listed herein are for the purpose of example only. Many other types of macro-ingredients and micro-ingredients may be used.

The diluent sources 110 may be in communication with one or more diluent pumps 250. Likewise, the concentrate sources 160 may be in communication with one or more concentrate pumps 260. The pumps 250, 260 may be of conventional design and capacity. One or more flow meters and the like also may be used herein with varying types of control systems. Other components and other configurations may be used herein.

Figure 2:
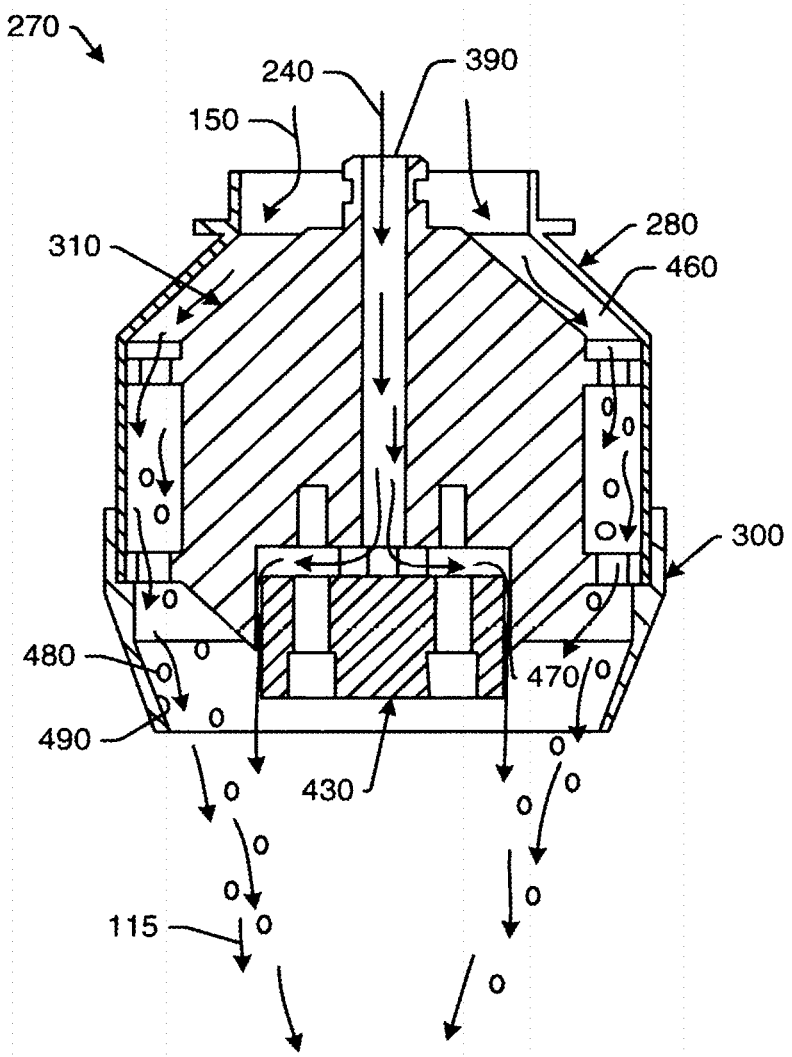
FIG. 2 is a side cross-sectional view of an example of a dispensing nozzle as may be described herein with a diluent flow and a Stevia-based concentrate flow.
Figure 3:
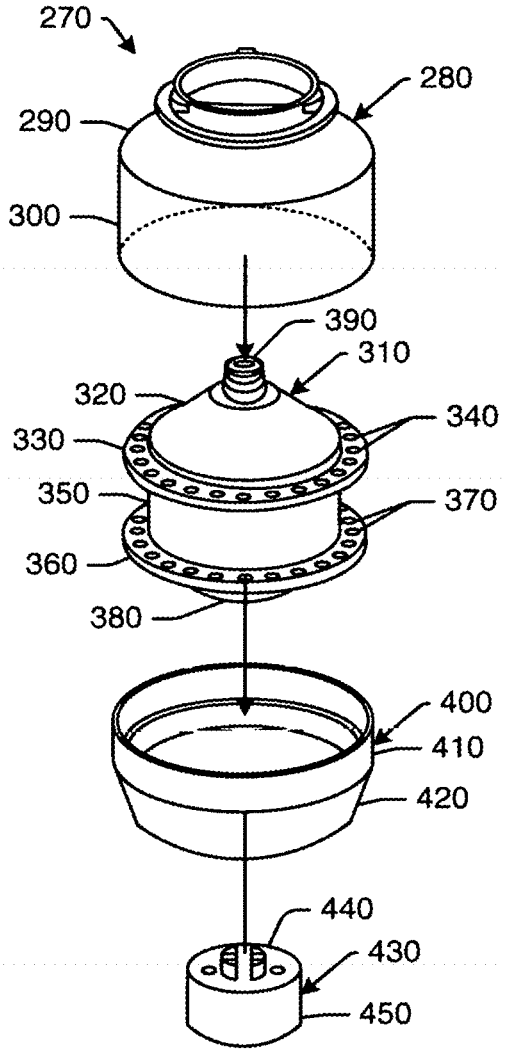
FIG. 3 is an exploded view of the dispensing nozzle of FIG. 2 with an upper shroud, a diffuser, a lower shroud, and a concentrate spreader.

The beverage dispenser 100 may include a dispensing nozzle 270 in communication with the diluent sources 110 and the concentrate sources 160. An example of the dispensing nozzle 270 is shown in FIGS. 2 and 3. As described above, the dispensing nozzle 270 mixes the concentrate stream and the diluent stream to create the beverage 115.

The dispensing nozzle 270 may include an upper shroud 280. The upper shroud 280 may include an upper shroud conical portion 290 and an upper shroud circular portion 300. A diffuser 310 may be positioned at least partly within the upper shroud 280. The diffuser 310 may include a diffuser upper conical portion 320, a first diffuser hole flange 330 with a number of first diffuser holes 340 therein, a diffuser circular portion 350, a second diffuser hole flange 360 with a number of second diffuser holes 370 therein, and a diffuser lower conical portion 380. A concentrate passage 390 extends through the length of the diffuser 310. Other components and other configurations may be used herein.

The dispensing nozzle 270 further may include a lower shroud 400. The lower shroud 400 may mate with the upper shroud 280 with the diffuser 310 therein. The lower shroud 300 may include a lower shroud circular portion 410 and a lower shroud conical portion 420. The dispensing nozzle 270 also may include a concentrate spreader 430. The concentrate spreader 430 may be positioned at least partly within the diffuser 310 and the lower shroud 400. The concentrate spreader 430 may include a concentrate spreader flow director 440 and a concentrate spreader circular portion 450. The concentrate spreader flow director 440 may include one or more flow channels and the like for directing the flow of the Stevia-based concentrate 240 and the like therethrough. Other components and other configurations may be used herein.

When the components of the dispensing nozzle 270 are assembled, the upper shroud 280 and the diffuser 310 may form an annular diluent path 460 therebetween. Likewise, the diffuser 310 and the concentrate spreader 430 may form an annular concentrate path 470 therebetween. The lower shroud conical portion 420 of the lower shroud 400 forms an angled mixing path 480 for the flow of water at the end of the annular diluent path 460. The angled mixing path 480 may have a shallow angle 490 therein. In this example, the shallow angle 490 may be in the range of about zero (0) to about seventy (70) degrees, with about five (5) to about sixty (60) degrees preferred, and with about ten (10) to about fifty (50) degrees more preferred. Other angles may be used herein. Other components and other configurations may be used herein.

In use, the dispensing nozzle 270 may be used with the diluent sources 110 including the carbonated water source 140. Likewise, the dispensing nozzle 270 may be used with a number of the concentrate sources 160 including the Stevia-based concentrate source 230. The upper shroud 280 and the diffuser 310 with the diffuser holes 340, 370 of the annular diluent path 460 may be sized and configured to reduce the velocity of the flow of the carbonated water 150 or other type of diluent therethrough. Specifically, the velocity of the flow of carbonated water may be reduced to about half that of a standard dispensing nozzle or so. Likewise, the diffuser 310 and the concentrate spreader 430 of the annular concentrate path 470 may be sized and configured such that the velocity of the Stevia-based concentrate stream 240 largely matches the velocity of the carbonated water stream 150 within a ratio thereof so as to minimize turbulence and carbon dioxide breakout. The velocity ratio may be about three to one (3:1) to about one to three (1:3) or so. Other ratios may be used herein. The angled mixing path 480 has the shallow angle 490 so as to direct the flow of carbonated water 150 into the flow of the Stevia-based concentrate 240 across a relatively large mixing interface again so as to limit turbulence. The concentric rings of the flow of carbonated water 150 and the flow of the Stevia-based concentrate 240 thus gently merge while increasing stream to stream contact to promote good mixing as the flows mix and fall towards the cup so as to form the beverage 115.

The combination of matching the velocity ratios of the fluid streams 150, 240 and the shallow angle 490 of the angled mixing path thus promote good distribution of the concentrate flow 240 over the water contact interface with minimized turbulence and shear so as to limit the formation of foam. The dispensing nozzle 270 thus may provide flow rates of about three (3) ounces per second (about 88.7 milliliters per second) or higher using the Stevia-based concentrate 240 with a minimum of foaming at a ratio or about 5.5 to 1. Other types of flow rates and ratios also may be used herein. The dispensing nozzle 270 thus may dispense at about twice the flow rate of existing nozzles or higher with less foam formation when used with the Stevia-based concentrate 240 and similar types of concentrates and other types of fluids. The dispensing nozzle 270 may include any suitable types of materials.

Although the dispensing nozzle 270 has been discussed in terms of the Stevia-based concentrate 240, other types of concentrates may be used herein. Moreover, the dispensing nozzle 270 may be used with any type of fluid flow that may be subject to high foaming and the like during mixing and dispensing. Combinations of differing types of nozzles also may be used.

Figure 4:
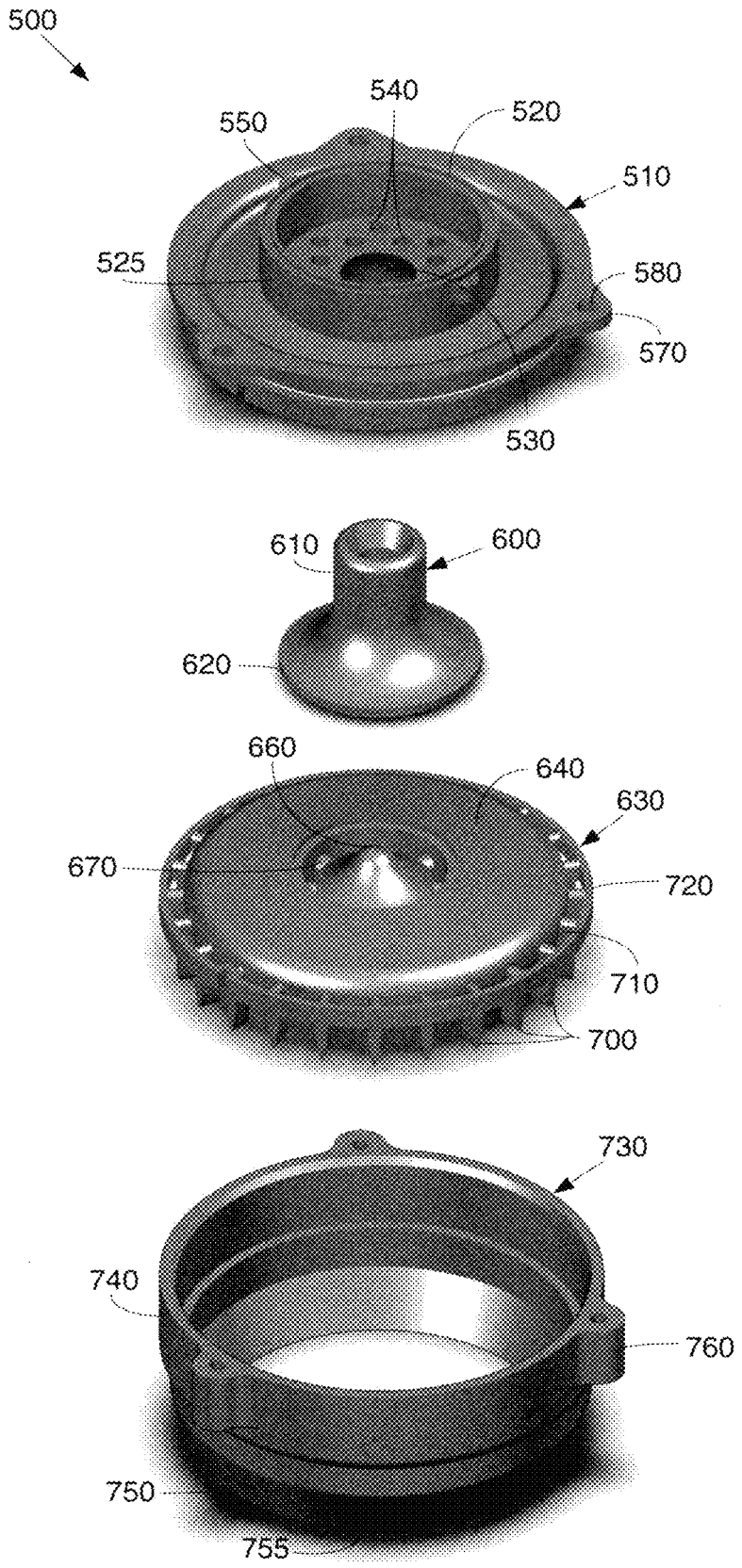
FIG. 4 is an exploded view of an alternative embodiment of a dispensing nozzle as may be described herein.

FIGS. 4 and 5 show a further embodiment of a dispensing nozzle 500 as may be described herein. Similar to that described above, the dispensing nozzle 500 may be in communication with the diluent sources 110 and the concentrate sources 160. The dispensing nozzle 500 mixes the diluent streams and the concentrate streams so as to create the beverage 115.

In this example, the dispensing nozzle 500 may include a top cover 510. The top cover 510 may be largely plate-like in shape. The top cover 510 may include a central chamber 520. The central chamber 520 may be defined by a circular chamber wall 525. The central chamber 520 may have one or more concentrate apertures 530 and one or more diluent apertures 540 therethrough. Any number of the apertures 530, 540 may be used herein. The apertures 530, 540 may have any suitable size, shape, or configuration. The concentrate aperture(s) 530 may be in communication with one of the concentrate sources 160. The diluent apertures 540 may be in communication with the diluent sources 110. The chamber wall 525 of the central chamber 520 may include one or more mounting bosses 550 thereon. The mounting bosses 550 may aid in attaching the dispensing nozzle 500 to a nozzle block 560 or elsewhere in communication with the beverage dispenser 500. The top cover 510 also may include an outer mounting flange 570. The mounting flange 570 may have a number of mounting apertures 580 thereon. The mounting apertures 580 may connect the top cover 510 to the other components of the dispensing nozzle 500 as may be described in more detail below. Other components and other configurations may be used herein.

The dispensing nozzle 500 also may include a diffuser cap 600. The diffuser cap 600 may be largely funnel-like in shape with an upper cylinder 610 and a bottom hyperboloid-like shape 620. The upper cylinder 610 may be sized to extend through the concentrate aperture 530 of the top cover 510. The diffuser cap 600 may have any suitable size, shape, or configuration. Other components and other configurations may be used herein.

The dispensing nozzle 500 also may include a diffuser 630. The diffuser 630 may include a top plate 640. The top plate 640 may have a central top plate aperture 650 therein. A concentrate spreader 660 may be positioned within the plate aperture 650. The concentrate spreader 660 may be somewhat cone-like in shape. The concentrate spreader 660 may have any suitable size, shape, or configuration. The top plate 640 may include a concentrate flange 680 that extends downward from the plate aperture 650. The concentrate spreader 660 may be attached to the concentrate flange 680 via a number of concentrate spreader ribs 670. The concentrate spreader 660 and the concentrate flange 680 may define an annular concentrate pathway 690 therethrough. In this example, about eight (8) concentrate pathways 690 may be formed between the concentrate spreader ribs 670. The configuration of the concentrate pathways 690 may have an impact on the concentrate flow characteristics therethrough. Although shown as separate components, the diffuser cap 600 and the diffuser 630 may be integrally formed. Other components and other configurations may be used herein.

The diffuser 630 may include a number of diffuser diluent ribs 700. The diffuser diluent ribs 700 may extend from the periphery of the top plate 640. The diffuser diluent ribs 700 may extend downwardly so as to define a number of diffuser pathways 710 therethrough. Any number of the diffuser diluent ribs 700 and the diffuser pathways 710 may be used herein in any size, shape, or configuration. An outer diffuser band 720 may encircle the diffuser diluent ribs 700 and provide support thereto. Other components and other configurations may be used herein.

The dispensing nozzle 500 also may include a lower shroud 730. The lower shroud 730 may include a lower shroud circular portion 740 and a lower shroud conical portion 750. The lower shroud 730 may have any suitable size, shape, or configuration. The lower shroud circular portion 740 may have a number of lower shroud mounting flanges 760 thereon. The mounting flanges 760 may mate with the mounting flanges 570 of the top cover 510. Alternatively, locking tabs, twist lock mechanisms, and the like also may be used. The lower shroud conical portion 750 may angle inward slightly so as to provide an angled mixing path 755 with a shallow angle at about ten degrees or less. Other angles may be used herein. For example, angles of about forty-five degrees or less also may be used. The lower shroud 730, along with the top cover 510 and the top plate 640 and the diffuser diluent ribs 700 of the diffuser 630 may form a number of annular diluent pathways 770. The configuration of the annular diluent pathways 710 may have an impact on the diluent flow characteristics therethrough. Other components and other configurations may be used herein.

The total cross-sectional area of the diluent pathways 770 may be greater than the total cross-sectional area of the concentrate pathways 690 given a substantially common velocity. Depending upon the nature of the concentrate the ratio may be about three to one (3:1) to about fifteen to one (15:1). Other ratios may be used herein. The ratio may vary by changing the number and/or size of the concentrate pathway 690 and/or the diluent pathway 770.

In use, the diffuser 630 may be positioned within the lower shroud 730. The diffuser cap 600 may be positioned within the concentrate aperture 530 of the top cover 510. The top cover 510 may be secured to the lower shroud 730. The dispensing nozzle 500 then may be connected to the diluent sources 110 and the concentrate sources 160. A flow of a concentrate such as the Stevia-based concentrate 240 may flow into the diffuser cap 600. The flow then may expand along the concentrate spreader 660 of the diffuser 630 and flow through the annular concentrate pathway 690. Likewise, a flow of a diluent 130, 150 may flow into the central chamber 520 of the top cover 510 and pass through the diffuser pathways 710. The size and shape of the diffuser pathways 710 may provide nucleation sites so as to begin carbon dioxide breakout before the streams begin to mix. The diluent then flows through the annular diluent pathway 770 defined by the top cover 510, the diffuser diluent ribs 700, and the lower shroud 730. The velocity of the concentrate and the diluent streams may be about the same.

As is shown in FIG. 5, the concentrate pathway 690 and the diluent pathway 770 may be positioned in a spaced apart configuration 780. Given the spaced apart configuration and the shallow angled mixing path 755, the flow of the diluent largely encircles the flow of the concentrate as the respective flows leave the nozzle 500. The flows thus do not mix, or mix substantially, until the flows enter a consumer's cup 790 downstream of the nozzle 500. Specifically, the flows may mix about one to about six inches (about 2.5 to about 15.2 centimeters) from the bottom of the lower shroud 730. The flows generally have little turbulence until mixing in the cup 790. This delay in mixing thus promotes little or at least a reduced amount of foaming therein. The delay in mixing, however, may be apparent to the consumer as the flows descend from the dispensing nozzle 500.

FIG. 6 shows an alternative embodiment of a dispensing nozzle 800 as may be described herein. In this example, the dispensing nozzle 800 may include an expanded diffuser cap 810 and a diffuser 630 with an expanded concentrate spreader 820. The expanded concentrate spreader 820 thus results in the concentrate pathway 690 being closer to the diluent pathway 770. As such, the concentrate pathways 690 and the diluent pathway 770 may be positioned in an intermediate configuration 830. The intermediate configuration 830 still results in the streams merging downstream of the nozzle 800 but at less of a distance as provided in the spaced apart configuration 780 described above. Specifically, the flows may mix about one-half to about two inches (about 1.3 to about 5.1 centimeters) from the bottom of the lower shroud 730. As a result, the intermediate configuration 830 may produce somewhat more foam than the spaced apart configuration 780 but with an increase in the visibility of the mixing. Other components and other configurations may be used herein.

FIG. 7 shows a further embodiment of a dispensing nozzle 840 as may be described herein. In this example, the dispensing nozzle 840 may include a further expanded diffuser cap 850 and a further expanded concentrate spreader 860. As a result, the concentrate pathway 690 and the diluent pathway 770 may be positioned in an adjacent configuration 870. The adjacent configuration 870 thus may result in the streams merging at about the bottom of the lower shroud 730. As a result, the adjacent configuration 870 may produce somewhat more foam than the intermediate configuration 830 but with an increase in the visibility of the mixing. Other components and other configurations may be used herein.

FIG. 8 shows a further embodiment of a dispensing nozzle 880 as may be described herein. In this example, the dispensing nozzle 880 may include a fully extended diffuser cap 890 and a fully extended concentrate spreader 900. As a result, the concentrate pathway 690 and the diluent pathway 770 may be positioned in an upstream configuration 910. The upstream configuration 910 thus may result in the streams merging in the lower shroud circular portion 740 and/or conical portion 750. As a result, the upstream configuration 910 may produce somewhat more foam than the adjacent configuration 870 but with an increase in the visibility of the mixing. Other components and other configurations may be used herein.

The dispensing nozzles described herein thus provide differing levels of foaming and visible stream mixing. Low foaming may be preferred given typical or conventional flow rates intended for a given cup size. The lack of mixing, however, may be an appearance concern. The dispensing nozzle 500 with the spaced apart configuration 780 thus may provide the lowest amount of foam because the mixing of the streams is delayed until the streams enter the consumer's cup 790. On the other hand, the dispensing nozzle 880 with the upstream configuration 910 immediately mixes the streams therein but may produce more foam. Other considerations may include color carry over between dispenses as well as over spray carbonation. Adequate mixing of the streams with little stratification also is desired herein. Even with the spaced apart configuration 780, good brix stratification was found in the finished beverage. The overall difference in the change in the brix level from the top to the bottom of the beverage was found to be within conventional specifications of about 1.0 brix and generally less that about 0.5 brix.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

We claim:

1. A dispensing nozzle for use with a flow of a diluent and a flow of a concentrate, comprising:
   - an annular concentrate path of the flow of the concentrate; and
   - an annular diluent path surrounding at least in part the annular concentrate path for the flow of the diluent;
   - the annular diluent path comprising a shallow angle leading towards the flow of the concentrate such that the flow of the diluent and the flow of the concentrate mix in or downstream of the dispensing nozzle;
   - wherein the annular concentrate path comprises a diffuser and a diffuser cap; and
   - wherein the diffuser comprises a concentrate spreader attached to a concentrate flange via a number of concentrate spreader ribs.

2. A dispensing nozzle for use with a flow of a diluent and a flow of a Stevia-based concentrate, comprising:
   - an annular concentrate path of the flow of the Stevia-based concentrate; and
   - an annular diluent path surrounding at least in part the annular concentrate path for the flow of the diluent;
   - the annular diluent path comprising a shallow angle leading towards the flow of the Stevia-based concentrate such that the flow of the diluent and the flow of the Stevia-based concentrate mix in or downstream of the dispensing nozzle;
   - wherein the annular diluent pathway comprises a top cover, a diffuser, a diffuser cap, and a lower shroud.

3. The dispensing nozzle of claim 2, wherein the top cover comprises a central chamber with a plurality of diluent apertures.

4. The dispensing nozzle of claim 3, wherein the diffuser cap extends through the central chamber of the top cover.

5. The dispensing nozzle of claim 2, wherein the diffuser comprises a plurality of diffuser diluent ribs defining a plurality of diffuser pathways therethrough.

6. The dispensing nozzle of claim 2, wherein the lower shroud comprises the shallow angle.

* * * * *